US007114928B2

(12) United States Patent
Asayama et al.

(10) Patent No.: US 7,114,928 B2
(45) Date of Patent: Oct. 3, 2006

(54) HIGH-PRESSURE FUEL PUMP AND ASSEMBLY STRUCTURE OF HIGH-PRESSURE PUMP

(75) Inventors: Kazuhiro Asayama, Nagoya (JP); Tomoji Ishikawa, Okazaki (JP); Naoki Kurata, Aichi-ken (JP); Daichi Yamazaki, Toyota (JP); Masanori Sugiyama, Aichi-ken (JP); Hiroshi Inoue, Chiryu (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/257,715

(22) PCT Filed: Apr. 17, 2001

(86) PCT No.: PCT/JP01/03259

§ 371 (c)(1),
(2), (4) Date: Oct. 16, 2002

(87) PCT Pub. No.: WO01/79686

PCT Pub. Date: Oct. 25, 2001

(65) Prior Publication Data

US 2003/0161746 A1 Aug. 28, 2003

(30) Foreign Application Priority Data

Apr. 18, 2000 (JP) ..... 2000-116420

(51) Int. Cl.
*F04B 19/00* (2006.01)

(52) U.S. Cl. ..... 417/470

(58) Field of Classification Search ..... 417/470, 417/471, 505; 91/171.1, 169 D, 164, 161; 123/507, 508, 509
See application file for complete search history.

(56) References Cited

U.S. PATENT DOCUMENTS

| | | | | |
|---|---|---|---|---|
| 1,812,013 | A * | 6/1931 | Muzzy | 417/148 |
| 1,882,988 | A * | 10/1932 | Schulze | 417/471 |
| 1,883,459 | A * | 10/1932 | Avigdor | 417/471 |
| 1,976,493 | A * | 10/1934 | Griffith et al. | 184/27.1 |
| 2,165,696 | A * | 7/1939 | Charter | 123/379 |
| 2,802,338 | A * | 8/1957 | Lardin | 91/169 |

(Continued)

FOREIGN PATENT DOCUMENTS

DE 306 442 4/1973

(Continued)

OTHER PUBLICATIONS

Patent Office of the People's Republic of China, First Office Action, dated Apr. 1, 2005.

*Primary Examiner*—Anthony Stashick
*Assistant Examiner*—Vikansha Dwivedi
(74) *Attorney, Agent, or Firm*—Kenyon & Kenyon LLP

(57) ABSTRACT

A high pressure pump for decreasing an initial axial force of a clamping bolt and preventing distortion of a sealing surface and a cylinder form. The high pressure pump has an intermediate member including a cylinder body. The cylinder body has a pressurizing chamber communicated with a cylinder accommodating a plunger. Fluid in the pressurizing chamber is pressurized by reciprocating the plunger. The intermediate member is arranged between a cover and a flange and clamped by a clamping bolt. The clamping bolt has an exposed area at its axially central area where the entire periphery of the clamping bolt is exposed from the cover and the flange. One or both of the cover and the flange clamp the intermediate member with a flexing elastic force.

3 Claims, 12 Drawing Sheets

U.S. PATENT DOCUMENTS

| | | | | | |
|---|---|---|---|---|---|
| 2,831,625 | A * | 4/1958 | Hartwell et al. | 417/446 |
| 3,039,393 | A * | 6/1962 | Yaindl | 417/427 |
| 3,622,251 | A * | 11/1971 | Allen | 417/471 |
| 4,060,350 | A * | 11/1977 | Indra | 417/490 |
| 4,073,277 | A * | 2/1978 | Eheim | 123/501 |
| 4,276,783 | A * | 7/1981 | Anderson | 74/15.63 |
| 4,705,006 | A | 11/1987 | Bastenhof | 123/506 |
| 4,915,602 | A * | 4/1990 | Tschopp | 417/503 |
| 5,011,382 | A * | 4/1991 | Thompson | 417/571 |
| 5,092,744 | A * | 3/1992 | Boers et al. | 417/397 |
| 5,362,215 | A * | 11/1994 | King | 417/455 |
| 5,364,234 | A * | 11/1994 | Eickmann | 417/273 |
| 6,338,295 | B1 * | 1/2002 | Kubota et al. | 92/100 |
| 6,447,273 | B1 * | 9/2002 | Nishimura et al. | 417/505 |
| 6,554,590 | B1 * | 4/2003 | Maeda et al. | 417/505 |
| 2002/0085936 | A1 * | 7/2002 | Chiba | 417/470 |
| 2003/0175137 | A1 * | 9/2003 | Inoue | 417/470 |

FOREIGN PATENT DOCUMENTS

| | | |
|---|---|---|
| FR | 2 640 324 | 6/1990 |
| GB | 1 579 711 | 11/1980 |
| GB | 2-265-943 A | 10/1993 |
| GB | 2 269 426 | 2/1994 |
| JP | 56-134719 U | 10/1981 |
| JP | 61-202679 U | 12/1986 |
| JP | 62-148760 U | 9/1987 |
| JP | 04-243302 | 8/1992 |
| JP | 11-210598 | 8/1999 |

* cited by examiner

HIGH-PRESSURE FUEL PUMP AND ASSEMBLY STRUCTURE OF HIGH-PRESSURE PUMP

BACKGROUND OF THE INVENTION

The present invention is related to a high pressure pump and a coupling structure of a high pressure pump, and more particularly, to a high pressure pump having an intermediate member, which includes a cylinder body to pressurize fluid in a pressurizing chamber by reciprocating a plunger in a cylinder and which is arranged between two clamping members, the intermediate member being clamped by a clamping bolt, which extends between the two clamping members, by means of the clamping members.

For example, Japanese Laid-Open Patent Publication No. 11-210598 discloses a high pressure fuel pump used for an engine such as a cylinder injection type gasoline engine. In the high pressure fuel pump, an intermediate member, such as a sleeve (corresponding to a "cylinder body"), is held by members such as brackets along the axial direction and clamped to a casing by a clamping bolt to improve the machining characteristic and the assembly characteristic.

Further, in the high pressure fuel pump, if the sleeve is just clamped, its cylinder form tends to be easily deformed. Therefore, a slit is formed between a clamping portion of the sleeve and the cylinder. The slit prevents the deformation caused by clamping cylindrical clamping members from affecting the cylinder form.

However, the clamping bolt for clamping the sleeve requires a relatively large initial, axial force. This is because the initial, axial force includes not only the axial force required for sealing the intermediate member but also requires the axial force required for coping with changes in the axial force resulting from fuel pressure pulsation that is produced when the high pressure pump is operated. Therefore, taking into consideration the change in the axial force of the high pressure pump, the intermediate member must be clamped with a relatively large initial, axial force when manufactured. However, when the intermediate member is clamped by a large initial, axial force with the clamping bolt, deformation of a sealing surface of the intermediate member or deformation of the cylinder form occurs. It is difficult to prevent such distortion.

BRIEF SUMMARY OF THE INVENTION

It is an object of the present invention to provide a high pressure pump and a coupling structure of a high pressure pump having small initial axial force of a clamping bolt and being capable of preventing distortion of a sealing surface or a cylinder shape.

In one perspective of the present invention, a high pressure pump includes a plunger, an intermediate member including a cylinder body for pressurizing fluid in a pressurizing chamber by reciprocating the plunger, wherein the cylinder body has a cylinder accommodating the plunger and the pressurizing chamber communicated with the cylinder. The high pressure pump has a first clamping member and a second clamping member arranged on two ends of the intermediate member and a clamping bolt extending between the two clamping members to clamp the intermediate member with the two clamping members. The clamping bolt has an exposed area at its axially central area where its entire periphery is exposed from the first clamping member and the second clamping member. One or both of the first clamping member and the second clamping member clamp the intermediate member with a flexing elastic force.

In this structure, the clamping force of the clamping bolt applies a compressive force and a flexing force on one of or both of the first clamping member and the second clamping member. At this time, the elastic coefficient of flexing elastic deformation that produces the clamping force is relatively small compared to the elastic coefficient of the compressive elastic deformation. That is, the deformation amount relative to the clamping force is large because it includes flexing deformation in addition to compressive deformation. Therefore, even if dimensional change occurs in the intermediate member or the clamping member due to temperature change, change of axial force is small because the elastic coefficient is small. Even if the initial axial force of the clamping bolt is relatively small, the axial force is sufficient for coping with dimensional change of the intermediate member and the clamping member after manufacturing. This prevents distortion of a sealing surface or a cylinder form.

Moreover, even if elastic deformation of the clamping member is caused by fluid pressure pulsation when the high pressure pump is activated, an increase in the axial force resulting from the deformation is suppressed at a low level because the deformation is caused by a bending force having a small elastic coefficient. As a result, the initial axial force of the clamping bolt is relatively small and distortion of the sealing surface or the cylinder form caused by fluid pressure pulsation during activation of the high pressure pump is prevented.

In another perspective of the present invention, a high pressure pump includes a plunger, an intermediate member including a cylinder body for pressurizing fluid in a pressurizing chamber by reciprocating the plunger, wherein the cylinder body has a cylinder accommodating the plunger and the pressurizing chamber communicated with the cylinder. The high pressure pump has a first clamping member and a second clamping member, arranged on two ends of the intermediate member, and a clamping bolt extending between the two clamping members for clamping the intermediate member with the two clamping members. The first clamping member and the second clamping member have separated portions at its axially central area of the clamping bolt where its entire periphery is separated from the separated portion by a predetermined distance. One or both of the first clamping member and the second clamping member clamp the intermediate member with a flexing elastic force.

In another aspect of the present invention, a high pressure pump includes a plunger, an intermediate member including a cylinder body for pressurizing fluid in a pressurizing chamber by reciprocating the plunger, wherein the cylinder body has a cylinder accommodating the plunger and the pressurizing chamber communicated with the cylinder. The high pressure pump has a first clamping member and a second clamping member arranged on two ends of the intermediate member and a clamping bolt provided between the two clamping members to clamping the intermediate member with the two clamping members. The first clamping member and the second clamping members are not directly engaged with each other. The clamping bolt clamps the first clamping member and the second clamping member at a position separated by a predetermined distance (S) from a position where the intermediate member is clamped by one of or both of the first clamping member and the second clamping member. One of or both of the first clamping member and the second clamping member clamp the intermediate member with a flexing elastic force.

BRIEF DESCRIPTION OF DRAWINGS

The invention, together with objects and advantages thereof, may best be understood by reference to the following description of the presently preferred embodiments together with the accompanying drawings.

DETAILED DESCRIPTION OF THE PREFERRED EMBODIMENTS (First Embodiment)

Figure 1:
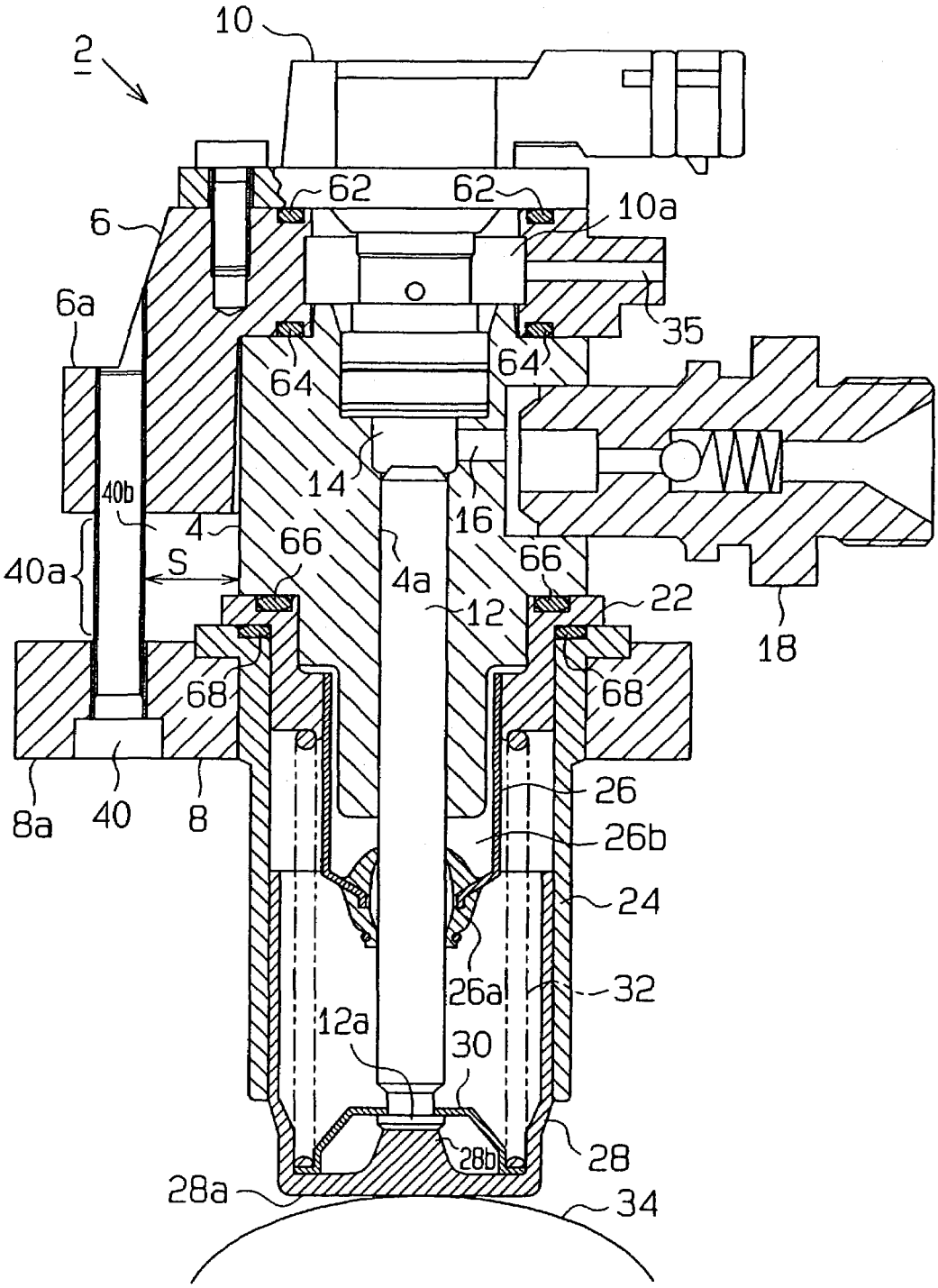
FIG. 1 is a cross sectional view showing a high pressure fuel pump according to a first embodiment of the present invention.

FIG. 1 is a cross sectional view of a high pressure fuel pump 2 according to a first embodiment of the present invention. The high pressure fuel pump 2 is installed in a cylinder injection type gasoline engine and generates high pressure fuel for injecting fuel into combustion chambers of the engine.

As shown in FIG. 1, the high pressure fuel pump 2 has a cylinder body 4, a cover 6, a flange 8 and an electromagnetic spill valve 10. A cylinder 4*a* is formed along the axis of the cylinder body 4. A plunger 12 is slidably supported in the cylinder 4*a* in the axial direction. A pressurizing chamber 14 is formed in the distal portion of the cylinder 4*a*. The volume of the pressurizing chamber 14 varies as the plunger 12 moves into or out of the pressurizing chamber 14.

Figure 2:
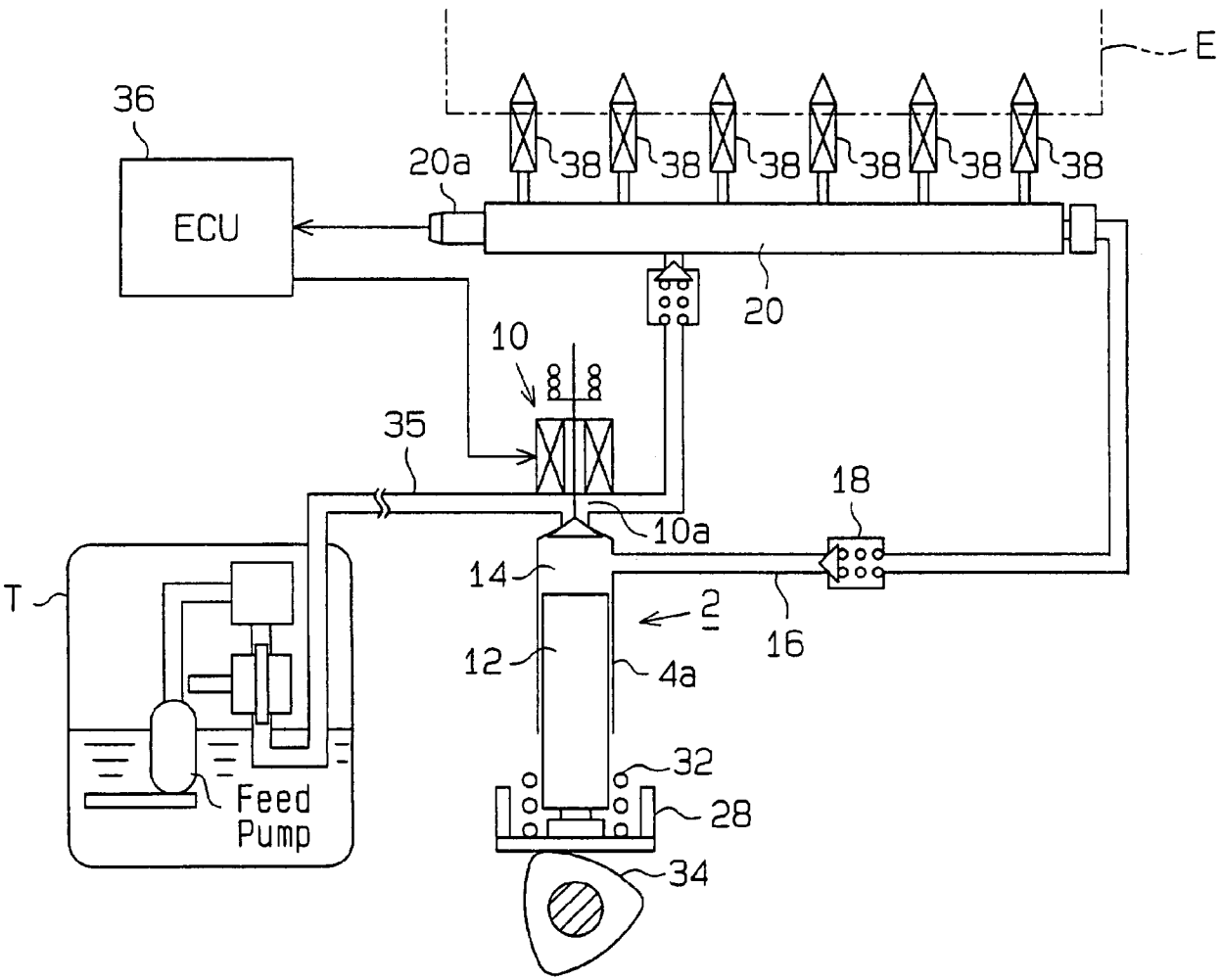
FIG. 2 is a diagrammatic drawing showing a fuel supplying system of an internal combustion engine incorporating the high pressure fuel pump of FIG. 1.

The pressurizing chamber 14 is connected to a check valve 18 via a fuel pressure supply passage 16. The check valve 18 is connected to a fuel distribution pipe 20 (FIG. 2). The check valve 18 is opened when the fuel in the pressurizing chamber 14 is pressurized and the high pressure fuel is supplied to the fuel distribution pipe 20.

A spring seat 22 and a lifter guide 24 are arranged in a stacked state at the lower side of the cylinder body 4. An oil seal 26 is attached to the inner surface of the spring seat 22. The oil seal 26 is generally cylindrical and has a lower portion 26*a* that is in slidable engagement with the peripheral surface of the plunger 12. Fuel leaked from the space between the plunger 12 and the cylinder 4*a* is stored in a fuel storing chamber 26*b* of the oil seal 26 and is returned to a fuel tank T via a fuel discharge passage (not shown), which is connected to the fuel storing chamber 26*b*.

A lifter 28 is accommodated in the lifter guide 24 slidably in the axial direction. A projected seat 28*b* is formed on an inner surface of a bottom plate 28*a* of the lifter 28. A lower end portion 12*a* of the plunger 12 engages the projected seat 28*b*. The lower end portion 12*a* of the plunger 12 is engaged with a retainer 30. A spring 32 is arranged between the spring seat 22 and the retainer 30 in a compressed state. The lower end portion 12*a* of the plunger 12 is pressed toward the projected seat 28*b* of the lifter 28 by the spring 32. The pressing force from the lower end 12*a* of the plunger 12 causes the bottom plate 28*a* of the lifter 28 to engage a fuel pump cam 34.

When the fuel pump cam 34 is rotated in cooperation with the rotation of the engine E, a cam nose of the fuel pump cam 34 pushes the bottom plate 28*a* upward and lifts the lifter 28. In cooperation with the lifter 28, the plunger 12 moves upward and compresses the pressurizing chamber 14. This lifting stroke of the plunger 12 corresponds to a fuel pressurizing stoke performed in the pressurizing chamber 14.

The electromagnetic spill valve 10 facing the pressurizing chamber 14 is closed at a proper timing during the pressurizing stroke. In the pressurizing process, prior to the closing of the electromagnetic spill valve 10, the fuel in the pressurizing chamber 14 returns to the fuel tank T via the electromagnetic spill valve 10, a gallery 10*a*, and a low pressure fuel passage 35. Therefore, fuel is not supplied from the pressurizing chamber 14 to the fuel distribution pipe 20. When the electromagnetic spill valve 10 is closed, the pressure of the fuel in the pressurizing chamber 14 increases suddenly and generates high pressure fuel. This opens the check valve 18 with the high pressure fuel and supplies the high pressure fuel to the distribution pipe 20.

When the cam nose of the fuel pump cam 34 starts to move downward, the urging force of the spring 32 starts to gradually move the lifter 28 and the plunger 12 downward (intake stroke). When the suction stroke starts, the electromagnetic spill valve 10 opens. This draws fuel into the pressurizing chamber 14 through the low pressure fuel passage 35, the gallery 10*a*, and the electromagnetic spill valve 10.

The pressurizing stroke and the suction stroke are performed repeatedly. The closing timing of the electromagnetic spill valve 10 during the pressurizing stroke is feedback controlled to adjust the fuel pressure in the fuel distribution pipe 20 at the optimal pressure for injecting fuel from the fuel injection valve 38. The feedback control is executed by an electric control unit (ECU) 36 in accordance with the fuel pressure in the fuel distribution pipe 20, which is detected by a fuel pressure sensor 20*a*, and the running condition of the engine.

The cylinder body 4, the spring seat 22 and the lifter guide 24 form an intermediate member of the high pressure fuel pump 2 and are arranged between the cover 6 (first clamping member) and the flange 8 (second clamping member) in a stacked state. As shown in FIG. 1, O-rings 62, 64, 66, 68 are arranged on the stacking surfaces of the electromagnetic spill valve 10, the cover 6, the cylinder body 4, the spring seat 22 and the lifter guide 24 to seal the gallery 10*a* and the fuel storing chamber 26*b*. That is, the O-ring 62 is arranged in the stacking surface between the electromagnetic spill valve 10 and the cover 6, and the O-ring 64 is arranged in the stacking surface between the cover 6 and the cylinder body 4. The O-ring 66 is arranged in the stacking surface between the cylinder body 4 and the spring seat 22, and the O-ring 68 is arranged in the stacking surface between the spring seat 22 and the lifter guide 24.

Figure 3:
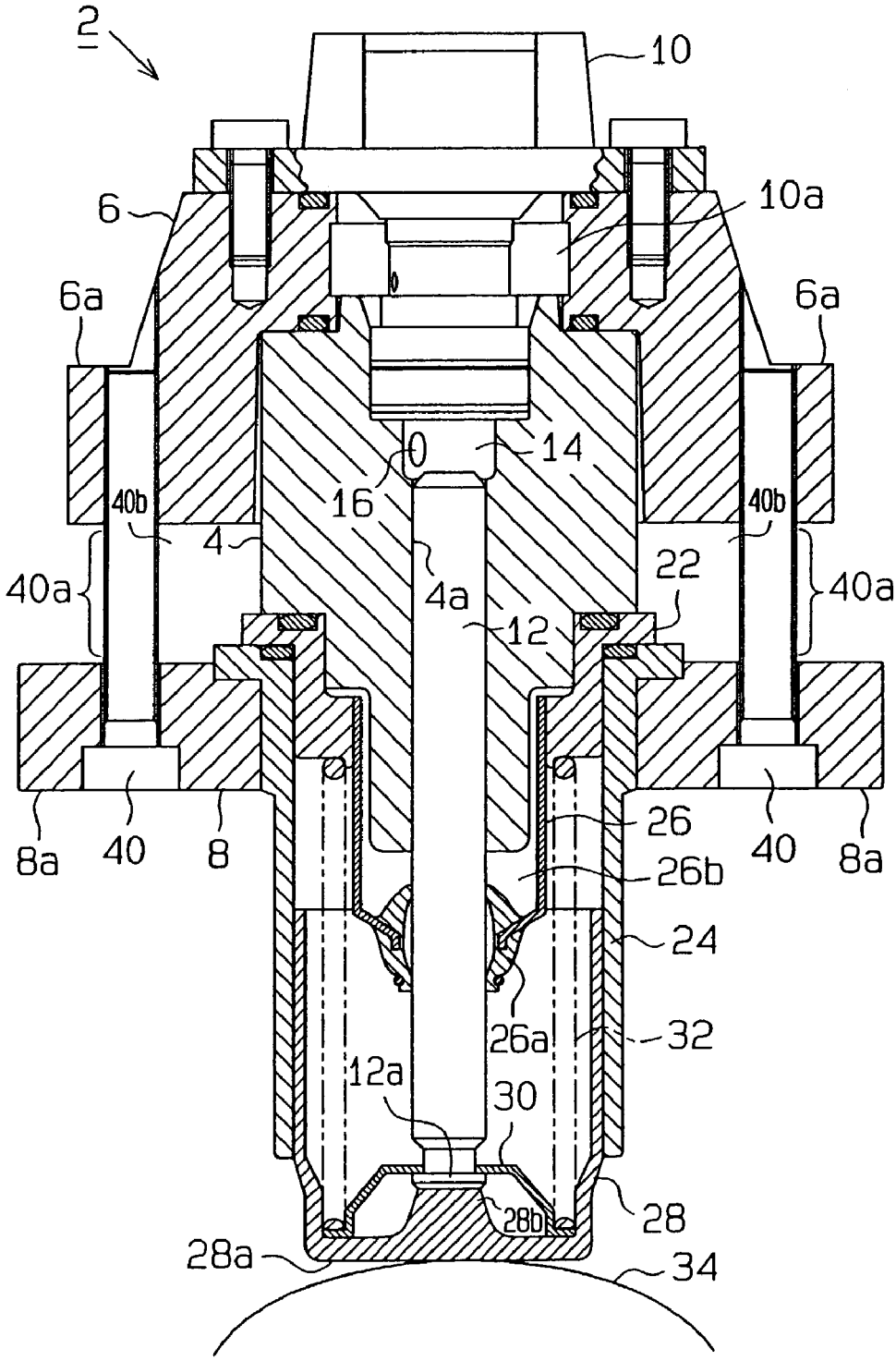
FIG. 3 is a cross sectional view of the high pressure fuel pump of FIG. 1.

The cylinder body 4, the spring seat 22, and the lifter guide 24 are clamped between the cover 6 and the flange 8 by a clamping bolt 40 that extends between the cover 6 and the flange 8. In the cross sectional view of FIG. 1, the cross section at the right side of the axis of the high pressure fuel pump 2 differs from the cross section at the left side of the axis. That is, the left cross sectional half and the right cross sectional half are views taken at different cutting angles. Therefore, only one of a plurality of clamping bolts 40 is shown in FIG. 1. FIG. 3 shows a cross sectional view of the high pressure fuel pump 2 taken along the same cutting plane. As shown in FIG. 3, two clamping bolts 40 are arranged about the axis in a symmetric manner. In the first embodiment, two sets of clamping bolts 40 are arranged in a symmetric manner around the cylinder body 4, the spring seat 22, and the lifter guide 24 to couple the cover 6 and the flange 8 to each other.

A central section 40*a* of the bolt 40 is not covered by the cover 6 or the flange 8. At part of the clamping bolt 40, the entire peripheral surface is exposed from the cover 6 and the flange 8. The clamping bolt 40 clamps the cover 6 and the flange 8 at a position separated from the cylinder body 4 by distance S. The distance S is a distance measured in a direction perpendicular to the clamping direction of the cover 6 and the flange 8.

In the high pressure fuel pump 2 according to the first embodiment, the central portions of the cover 6 and the flange 8 clamp the cylinder body 4, the spring seat 22, and the lifter guide 24 in a stacked state. The peripheral portions of the cover 6 and the flange 8 are clamped by the plurality of clamping bolts 40.

Unlike when the central section 40*a* of the clamping bolt 40 is covered by the cover 6 and the flange 8, the clamping force of the clamping bolt 40 compresses and deforms the cover 6 and the flange 8 and also flexes and deforms the cover 6 and the flange 8. Therefore, the peripheral portion 6*a* of the cover 6 and the peripheral portion 8*a* of the flange 8 move toward each other. In this state, the clamping force, which results from the flexing elastic force of the cover 6 and the flange 8, is applied to the cylinder body 4, the spring seat 22, and the lifter guide 24.

The high pressure fuel pump 2 of the first embodiment has the following advantages.

(1) In the high pressure fuel pump 2, the cylinder body 4, the spring seat 22, and the lifter guide 24 are arranged between the cover 6 and the flange 8. The cylinder body 4, the spring seat 22, and the lifter guide 24 are clamped by the clamping bolt 40, which extends between the cover 6 and the flange 8. The entire peripheral surface at the axially central section 40*a* of the clamping bolt 40 is exposed from the cover 6 and the flange 8. Therefore, the clamping force of the clamping bolt 40 functions as a compressive force, which is applied to the cover 6 and the flange 8, and a flexing force, which is applied in a direction that moves the peripheral portion 6*a* of the cover 6 and the peripheral portion 8*a* of the flange 8 toward each other. The elastic coefficient of the flexing elastic deformation is smaller than that of the compressive elastic deformation. The flexing elastic deformation generates a clamping force applied to the cylinder body 4, the spring seat 22, and the lifter guide 24.

Therefore, even if the dimension of the intermediate member changes because of expansion or shrinkage due to temperature change or because of wear of the intermediate member (the cylinder body 4, the spring seat 22, the lifter guide 24), the elastic coefficient of the flexing elastic deformation is small. Thus, change in the axial force is small. Even if the initial axial force of the clamping bolt 40 is relatively small, the generated axial force is sufficient for coping with the dimensional changes of each component of the high pressure fuel pump 2 subsequent to manufacturing. As a result, the initial axial force of the clamping bolt 40 is small, and the sealing surface of the cover 6, the cylinder body 4, the spring seat 22, the lifter guide 24, and the flange 8 are not deformed and the cylinder 4*a* is not deformed.

(2) Even if the cover 6 or the flange 8 is elastically deformed due to the fuel pressure pulsation generated when the high pressure fuel pump 2 is activated or due to a sudden increase of the fuel pressure when the electromagnetic spill valve 10 is closed, an increase in the axial force resulting from deformation is suppressed since the elastic deformation is caused by a flexing force having a small elastic coefficient. Therefore, distortion caused by deformation of the sealing surfaces and the cylinder 4*a* when the high pressure fuel pump 2 produces fuel pressure pulsation is prevented.

(3) The cover 6 and the flange 8 are not in direct engagement with each other. Accordingly, the clamping force applied to the cylinder body 4, the spring seat 22, and the lifter guide 24 is mainly the flexing elastic deformation. Therefore, the elastic coefficient is small enough, and the advantages of (1) and (2) are improved.

(4) The cover 6 and the flange 8 clamp the cylinder body 4, the spring seat 22 and the lifter guide 24 at their central portions, and the cover 6 and the flange 8 are clamped by a plurality of clamping bolts 40 at their peripheral portions. This clamps the cylinder body 4, the spring seat 22, and the lifter guide 24 in a well-balanced manner, and the advantages of (1) and (2) are improved.

Figure 4:
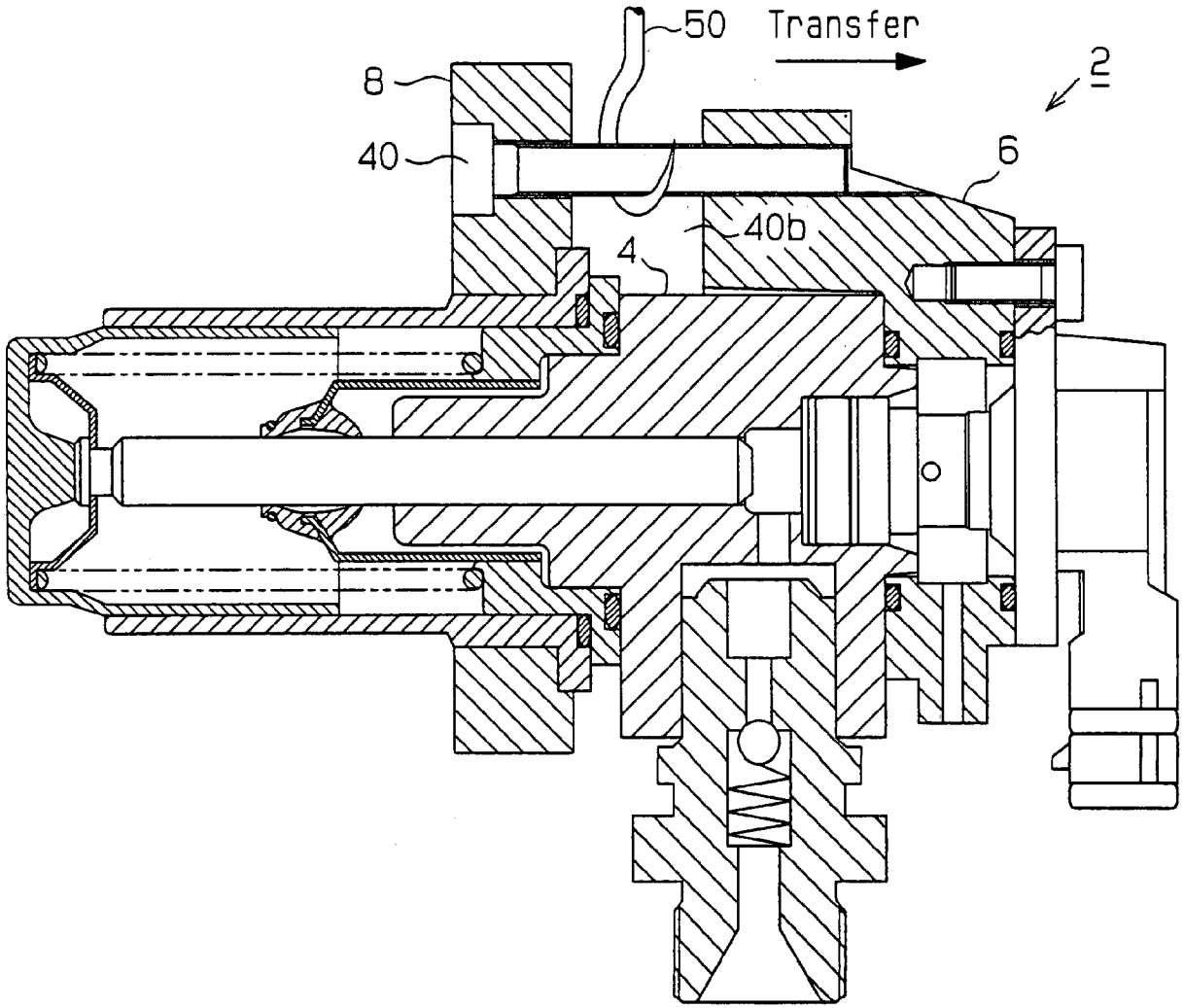
FIG. 4 is an explanatory view showing a transferring state of the high pressure fuel pump of FIG. 1.

(5) The central section 40*a* of the clamping bolt 40 is separated from the cylinder body 4, the cover 6, the flange 8 and other components so that the central section 40*a* of the clamping bolt 40 is completely exposed from the high pressure fuel pump 2. This defines an open space 40*b* is formed. The open space 40*b* is used to hook the high pressure fuel pump 2 with a transferring hook 50 in a manufacturing line, as shown in FIG. 4. Accordingly, the high pressure fuel pump 2 is transferred by a simple transfer line without having to attach an engaging member, such as bracket, to the high pressure fuel pump 2 or without performing machining to enable engagement. Therefore, the manufacturing cost is decreased.

(6) The cover 6 and the flange 8 are separated from each other along the entire periphery of the high pressure fuel pump 2. The stacked portion of the cylinder body 4, the spring seat 22, and the lifter guide 24 is seen from between the cover 6 and the flange 8. Therefore, for example, the stacked portion can be easily seen from the outer side of the high pressure fuel pump 2 to check whether there are any problem, such as cracking of the stacked portion, when performing inspections after manufacturing process or during use.

(7) As shown in FIG. 1, the cylinder body 4, the spring seat 22, and the lifter guide 24 are cylindrical. Thus, the cylinder body 4, the spring seat 22 and the lifter guide 24 are easily manufactured by performing machining with a lathe. The cover 6 and the flange 8 are also machined in the same manner. This simplifies the formation of the high pressure fuel pump 2.

(8) The cylinder body 4, the spring seat 22 and the lifter guide 24 are entirely cylindrical. Thus, when forming threaded holes in these components, the phase relative to the axis does not have to be fixed. Moreover, when a certain part is attached to the cylinder body 4, the spring seat 22 and the lifter guide 24, the part may be attached from any direction as long as the part does not interfere with the central section 40*a* of the clamping bolt 40. This reduces restrictions when designing and assembling the high pressure fuel pump 2.

Figure 5:
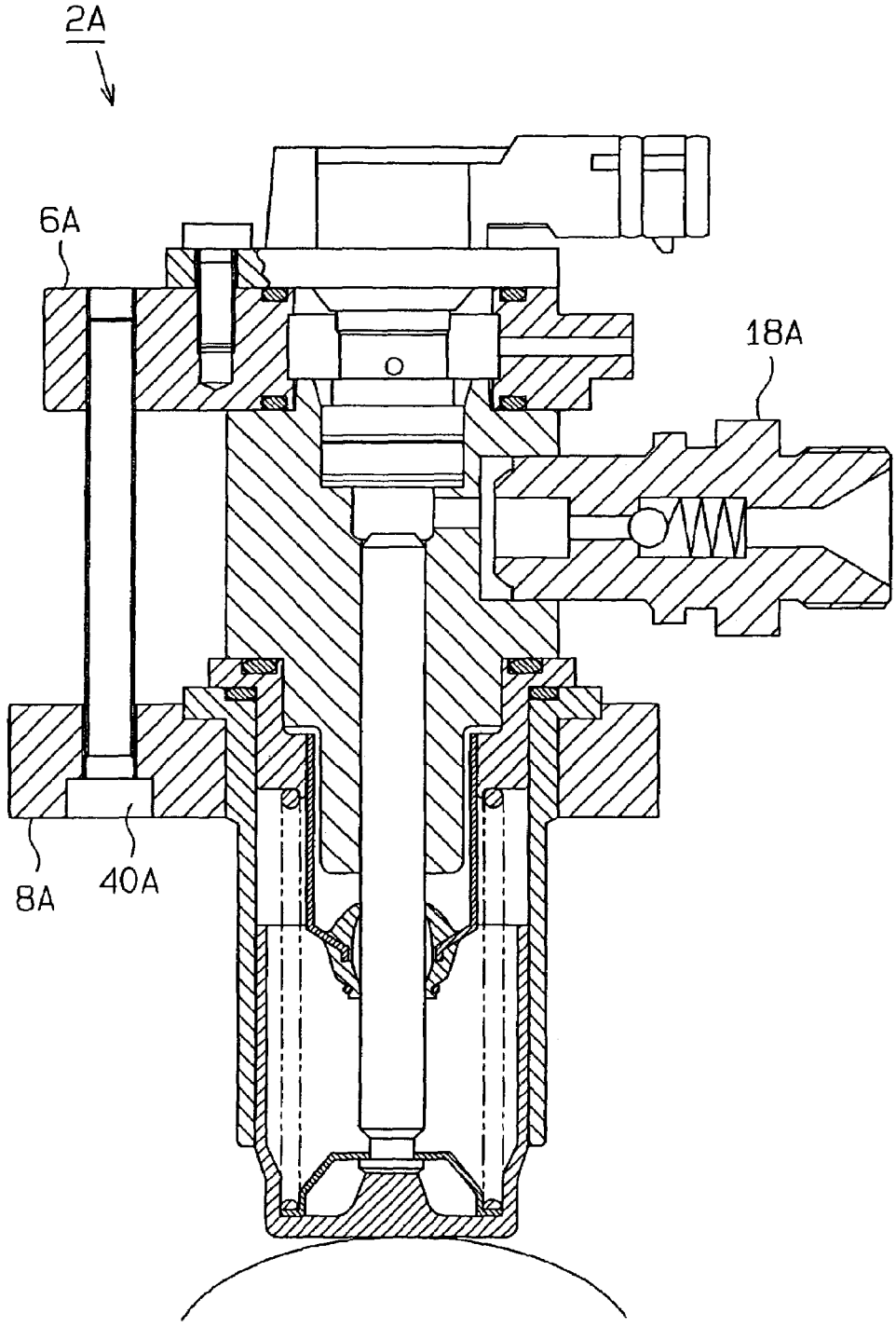
FIG. 5 is a cross sectional view showing a modified example of the high pressure fuel pump of FIG. 1.

As shown in FIG. 5, the space between a cover 6A and a flange 8A can be increased. In this case, the attaching phase of a relatively large part, such as a check valve 18A, has less restrictions.

(9) The central section 40*a* of the clamping bolt 40 is exposed and the cover 6 and the flange 8 are not engaged with each other. In this state, the cylinder body 4, the spring seat 22, and the lifter guide 24 are clamped by the flexing deformation of the cover 6 and the flange 8. Therefore, the axial dimensions of each component of the high pressure fuel pump 2 does not need high accuracy. Since the clamping force is adjusted by the screwed amount of the clamping bolt 40, manufacturing is facilitated. Moreover, because the elastic coefficient of the flexing deformation is small, change in the axial force caused by errors in the screwed amount is small. As a result, the screwed amount does not have to be highly accurate.

(10) Even if a temperature change causes a dimensional change of the high pressure fuel pump 2, the generated axial force is sufficient for coping with the dimensional change. Therefore, parts that are especially important to achieve the pumping function, such as the cylinder body 4, may be manufactured from a high quality material while other parts that are not so important may be manufactured from a relatively low quality material. This decreases the material cost of the high pressure fuel pump 2.

(Second Embodiment)

Figure 6:
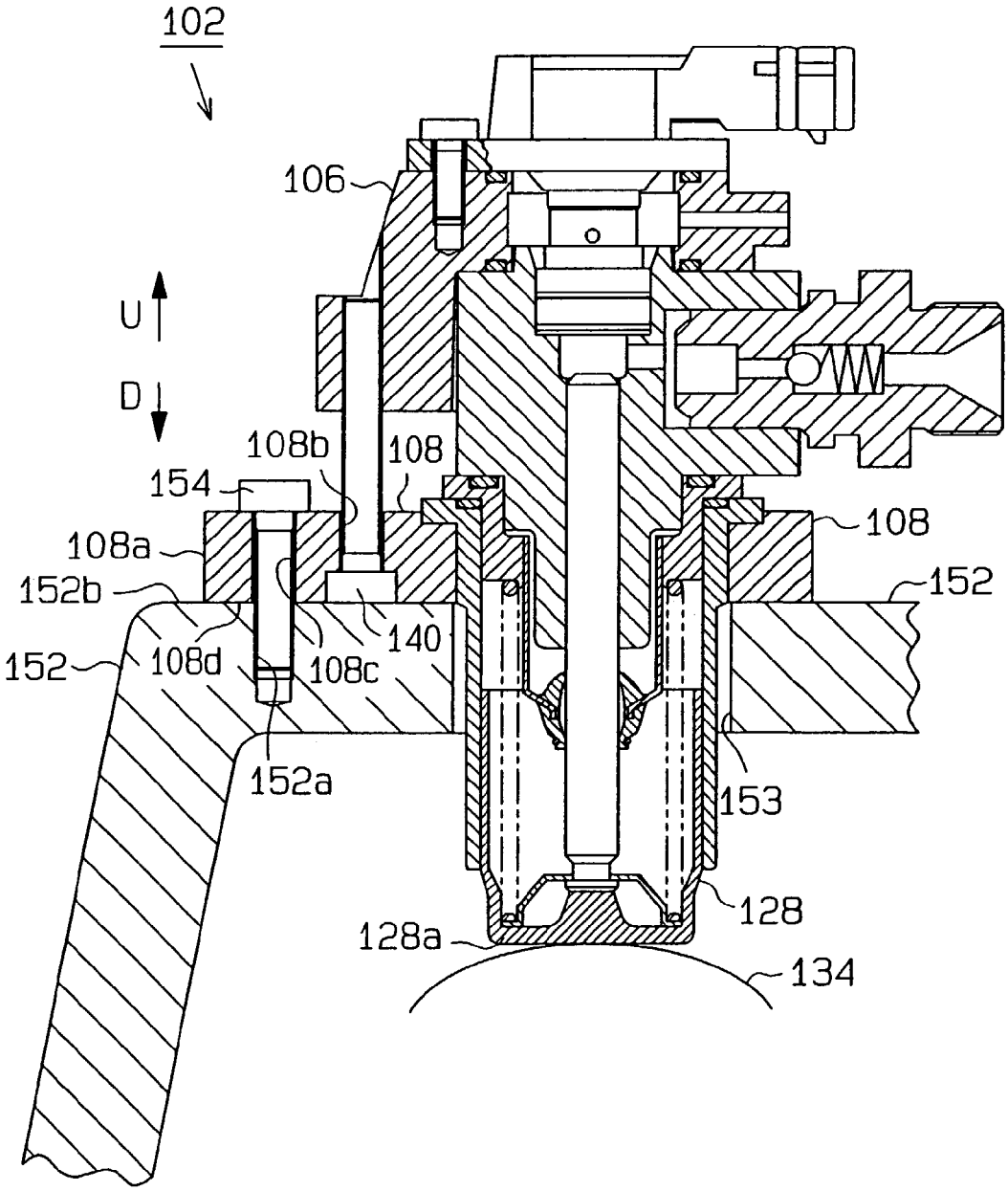
FIG. 6 is a cross sectional view showing a coupling structure of a high pressure fuel pump according to a second embodiment of the present invention.

FIG. 6 is a cross sectional view of a high pressure fuel pump 102 according to a second embodiment of the present invention. The high pressure fuel pump 102 is incorporated in a cylinder injection type gasoline engine and generates high pressure fuel for injecting fuel into combustion chambers of the engine. The high pressure fuel pump 102 is arranged on a cylinder head cover 152 (supporting member) of the engine by an fastening bolt 154.

The structure of the high pressure fuel pump 102 is the same as the structure of the high pressure fuel pump 2 of the first embodiment except for a flange 108. The flange 108 of the second embodiment has a fastening bolt hole 108*c* for receiving the fastening bolt 154. The fastening bolt hole 108*c* is formed further outward toward the peripheral portion from a clamping bolt hole 108*b* for receiving a clamping bolt 140.

The high pressure fuel pump 102 is attached to the cylinder head cover 152 by the fastening bolt 154. The fastening bolt 154, which extends through the fastening bolt hole 108*c* in a direction opposite to the extending direction of the clamping bolt 140, is screwed in a screwing hole 152*a*. A bottom plate 128*a* of a lifter 128 engages a fuel pump cam 134 of the engine via a through hole 153 in the cylinder head cover 152.

Figure 7:
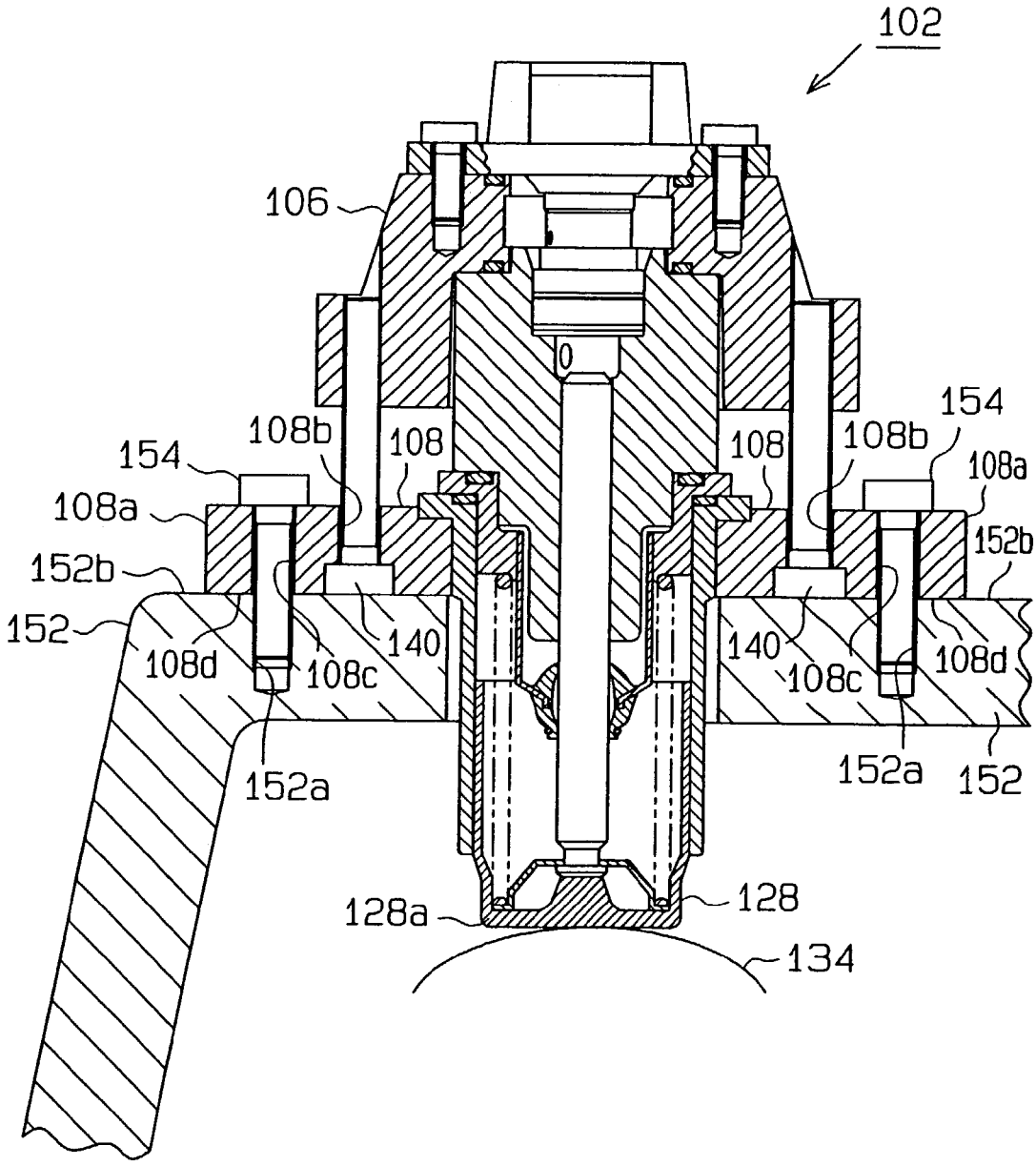
FIG. 7 is a cross sectional view showing a couling structure of the high pressure fuel pump of FIG. 6.

In the cross sectional view of FIG. 6, the cross section at the right side of the axis of the high pressure fuel pump 102 differs from the cross section at the left side of the axis. That is, the left cross sectional half and the right cross sectional half are views taken at different cutting angles. Therefore, only one of the clamping bolts 140 and one of the fastening bolts 154 are shown in FIG. 7. FIG. 7 shows a cross sectional view of the high pressure fuel pump 2 taken along the same cutting plane. As shown in FIG. 7, two clamping bolts 140 and two fastening bolts 154 are arranged about the axis in a symmetric manner. In the second embodiment, two sets of the clamping bolts 140 are arranged in a symmetric manner around the cylinder body 4, the spring seat 22, and the lifter guide 24 to couple the cover 106 and the flange 108 to each other. Further, two sets of the fastening bolts 154 are arranged in a symmetric manner around the clamping bolts 140 to couple the flange 108 and the cylinder head cover 152 to each other.

The high pressure fuel pump 102 of the second embodiment has the following advantages in addition to the advantages of the high pressure fuel pump 2 of the first embodiment.

(1) In the high pressure fuel pump 102 of the second embodiment, a lower surface 108*d* of the flange 108 defines an attaching surface that is attached to the cylinder head cover 152. When assembling the high pressure fuel pump 102, a peripheral portion 108*a* of the flange 108 is slightly bent toward the cover 106 (the direction indicated by arrow U in FIG. 6) when the flange 108 is clamped to the cover 106 by the clamping bolt 140. This decreases the degree of contact between the surface 152*b* of the cylinder head cover 152 and the lower surface 108*d* of the flange 108.

When the flange 108 is attached to the cylinder head cover 152 by the fastening bolt 154, the flange 108 is clamped to the cylinder head cover 152 closer to the peripheral portion 108*a* from the clamping bolt 140. At this time, a fastening force acting in a direction opposite to the direction of arrow U in FIG. 6 (a direction of an arrow D) is generated at the peripheral portion 108*a*.

Therefore, even if the peripheral portion 108*a* of the flange is flexed in the direction indicated by arrow U in FIG. 6 by the clamping bolt 140, the peripheral portion 108*a* flexes back so as to engage the cylinder head cover 152. This increases the degree of contact between the surface 152*b* of the cylinder head cover 152 and the flange 108 and improves the sealing property between the cylinder head cover 152 and the flange 108.

Accordingly, even if a thin and light flange 108 is used, the clamping force of the clamping bolt 140 prevents the degree of contact between the surface 152*b* of the cylinder head cover 152 and the flange 108 from decreasing. Moreover, when the flatness tolerance of the lower surface 108*d* of the flange 108 is large, the fastening force of the fastening bolt 154 increases the degree of contact between the surface 152*b* of the cylinder head cover 152 and the flange 108. This decreases the material cost and the machining cost.

When the lower surface 108*d* of the flange 108 and the surface 152*b* of the cylinder head cover 152 are sealed by an O-ring, the squeezing margin of the O-ring is small. Therefore, sufficient sealing is enabled by a small amount of material, and the material cost is decreased.

(Third Embodiment)

Figure 8:
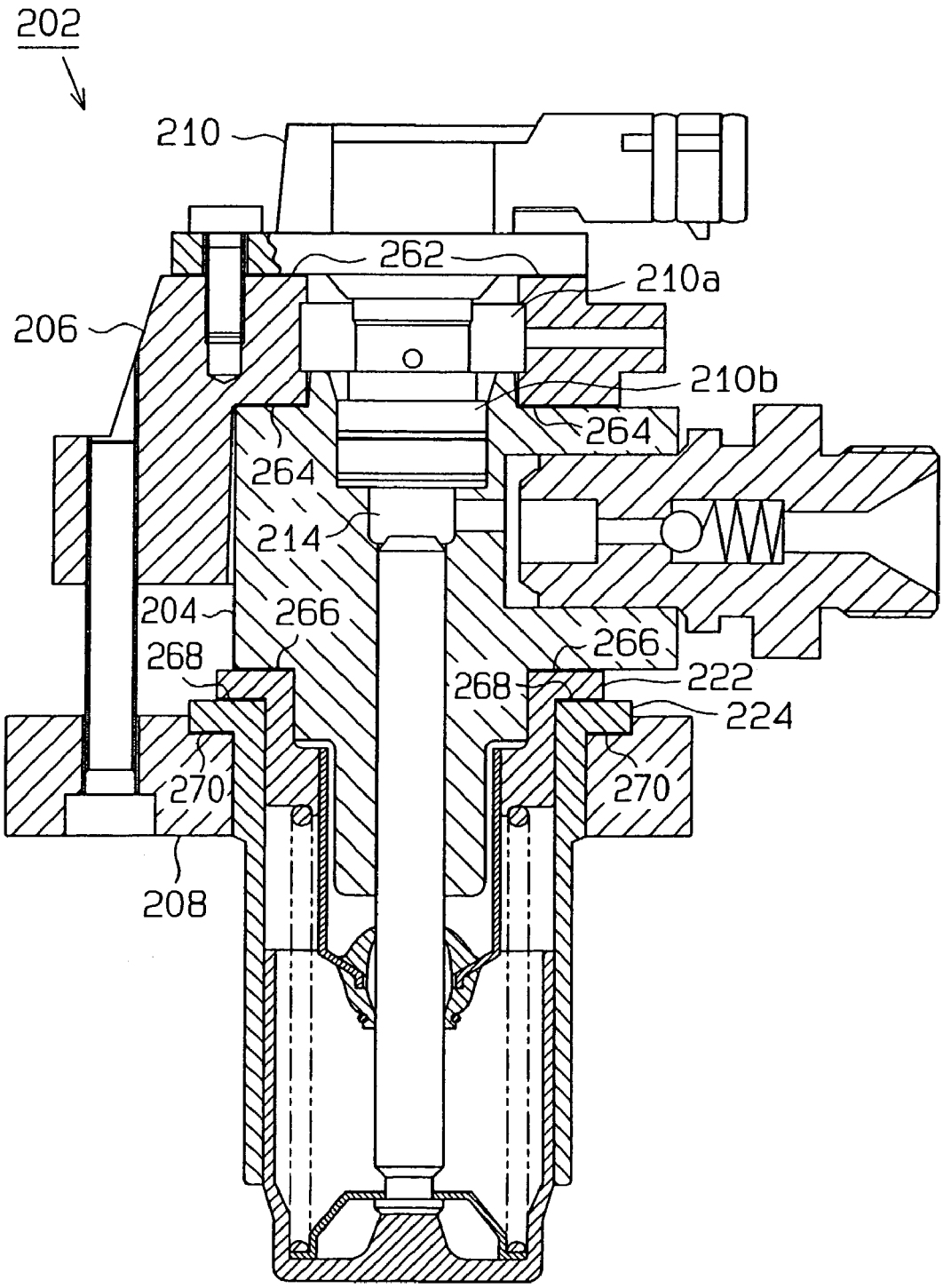
FIG. 8 is a cross sectional view showing a high pressure fuel pump according to a third embodiment of the present invention.

FIG. 8 is a cross sectional view of a high pressure fuel pump 202 of a third embodiment. In the same manner as the first embodiment, an electromagnetic spill valve 210, a cover 206, a cylinder body 204, a spring seat 222, a lifter guide 224, and a flange 208 are stacked in the axial direction of the high pressure fuel pump 202.

In the high pressure fuel pump 202 of the third embodiment, instead of the O-rings of the first embodiment, sealing members (for example, rubber) 262, 264, 266, 268, 270 having a vibration attenuation characteristic are arranged on the stacking surfaces of the electromagnetic spill valve 210, the cover 206, the cylinder body 204, the spring seat 222, the lifter guide 224 and the flange 208. As shown in FIG. 8, the sealing member 262 is arranged on the stacking surface of the electromagnetic spill valve 210 and the cover 206, and the sealing member 264 is arranged on the stacking surface of the cover 206 and the cylinder body 204. The sealing member 266 is arranged on the stacking surface of the cylinder body 204 and the spring seat 222, and the sealing member 268 is arranged on the stacking surface of the spring seat 222 and the lifter guide 224.

The high pressure fuel pump 202 of the third embodiment has the following advantages in addition to the advantages of the high pressure fuel pump 2 according to the first embodiment.

(1) When the electromagnetic spill valve 210 closes, the flow of fuel that flows through the electromagnetic spill valve 210 stops instantaneously. When a valve body arranged in the electromagnetic spill valve 210 is received by a seat portion 210*b*, the seat portion 210*b* generates impact vibrations. A pressurizing chamber 214 of the cylinder body 204 directly receives the impact vibrations. However, the impact vibrations is attenuated a number of times by the sealing members 262–270, and the vibrations are prevented from being transferred outside. The vibrations is not transferred because the cylinder body 204 (the intermediate member) is held between the cover 206 and the flange 208 in a floating state.

The O-rings 62–68 of the first embodiment impact vibrations properly attenuate impact vibrations and restrict the transmission of the impact vibrations. However, this is performed more effectively in the third embodiment.

Figure 9:
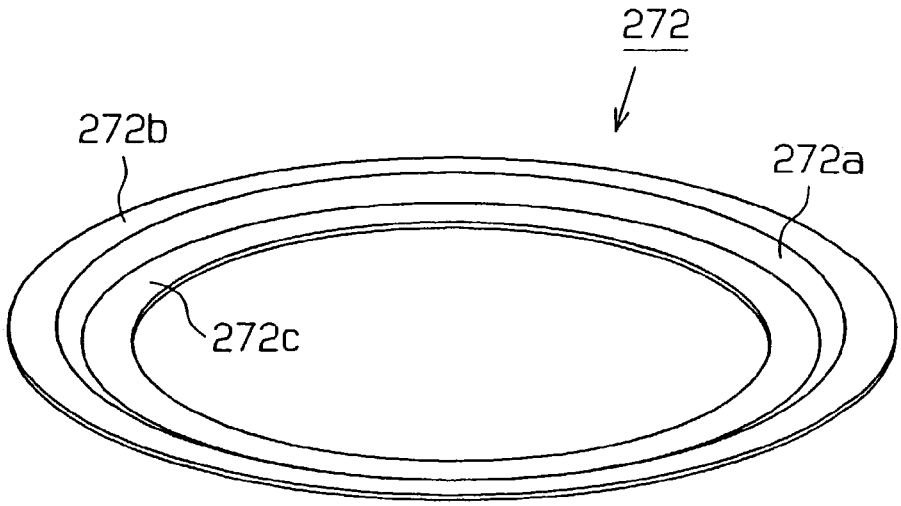
FIG. 9 is a perspective view showing a ring-like metal plate that is used as a sealing member in the high pressure fuel pump of FIG. 8.
Figure 10:
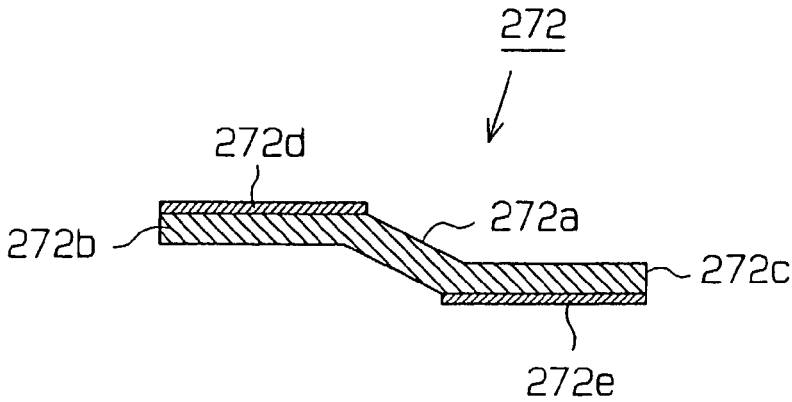
FIG. 10 is a cross sectional view showing the ring-like metal plate of FIG. 9.
Figure 11:
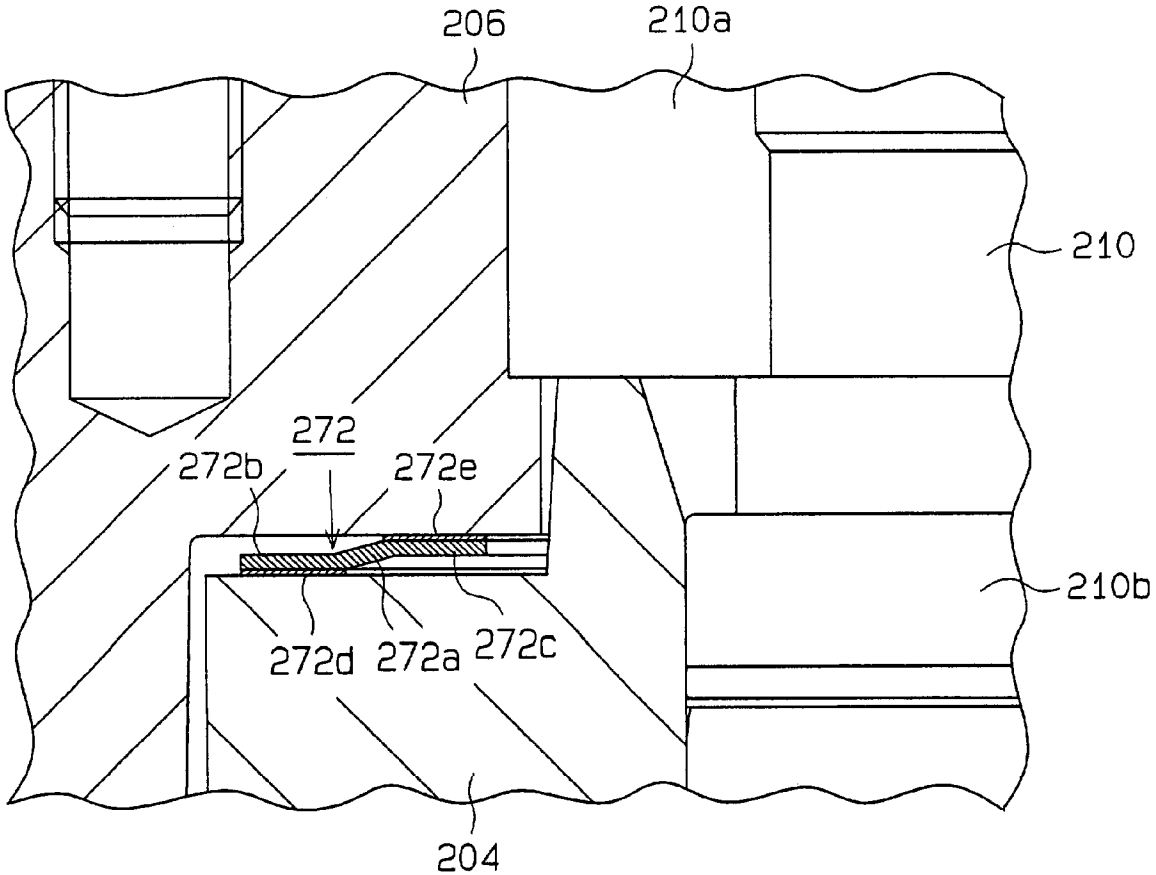
FIG. 11 is a cross sectional view showing a main portion of the high pressure fuel pump to illustrate the ring-like metal plate of FIG. 9 when it is used.

The sealing members 262–270 may be a seat of rubber or resin. However, for example, the sealing members 262–270 may be a ring-like metal plate 272 as shown in the perspective view of FIG. 9 and the enlarged cross sectional view of FIG. 10. The ring-like metal plate 272 has two ring portions 272*b*, 272*c* that are connected by a tapered step 272*a*. Ring-like rubber seats 272*d*, 272*e* are arranged on the upper surface and lower surface of the ring portions 272*b*, 272*c* as shown in FIG. 10. For example, as shown in FIG. 11, the ring-like metal plate 272 is arranged between the cover 206 and the cylinder body 204 in a compressed state in lieu of the sealing member 264. Ring-like metal plates are also arranged in a compressed condition in lieu of the sealing members 262, 266–270. This seals a gallery 210*a*, attenuates the vibrations transferred from the electromagnetic spill valve 210 to the cylinder body 204, and prevents vibrations from being transferred to the cover 206 or the flange 208.

(Further Embodiments)

Figure 12:
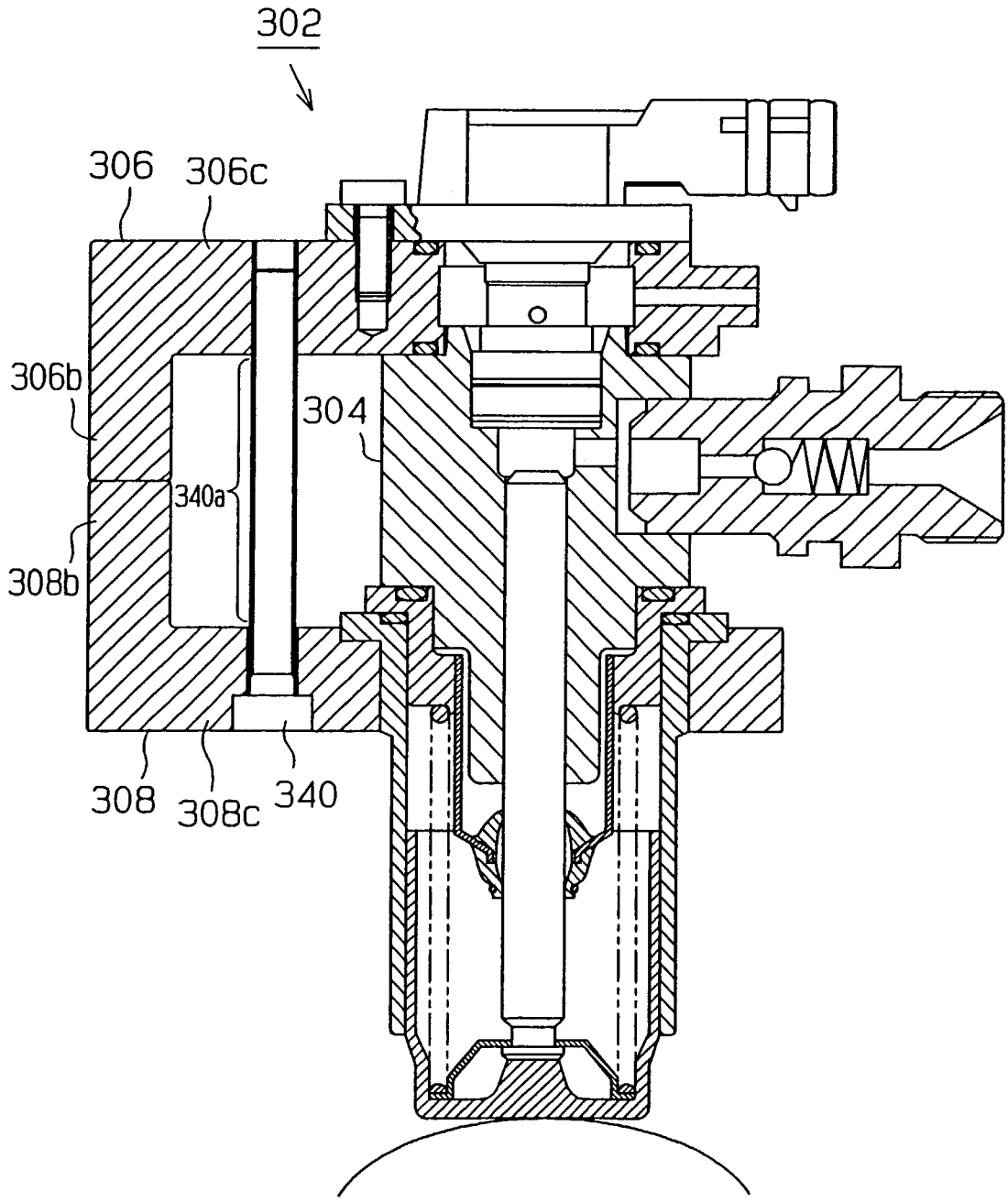
FIG. 12 is a cross sectional view showing a high pressure fuel pump according to a further embodiment of the present invention.

As shown in FIG. 12, a cover 306 and a flange 308 may be engaged with each other at a contact portion (separated portion) 306*b* of the cover 306 and a contact portion (separated portion) 308*b* of the flange. The contact portion 306*b* and the contact portion 308*b* are separated from the cylinder body 304 (intermediate member) and a clamping bolt 340 by a predetermined distance.

In this case also, as long as there is a portion where the entire periphery of the clamping bolt 340 is exposed in the axially central area 340*a* of the clamping bolt 340, in either the cover 306 or the flange 308 or in both of the cover 306 and the flange 308 (both in the case of FIG. 12), portions 306*c*, 308*c* orthogonal to the axis of the clamping bolt 340 are elastically deformed. This clamps the cylinder body 304 with the elastic force, which elastic coefficient is low.

In this case, the contact portions 306*b*, 308*b* are separated from the clamping position of the cylinder body 304. The cover 306 and the flange 308 clamp the cylinder body 304 by means of the flexing deformation. Therefore, even if the axial dimension of each component in the high pressure fuel pump 302 does not have high accuracy and has dimensional tolerance, the dimensional tolerance is absorbed without producing a large change in the axial force of the clamping bolt 340.

Figure 13:
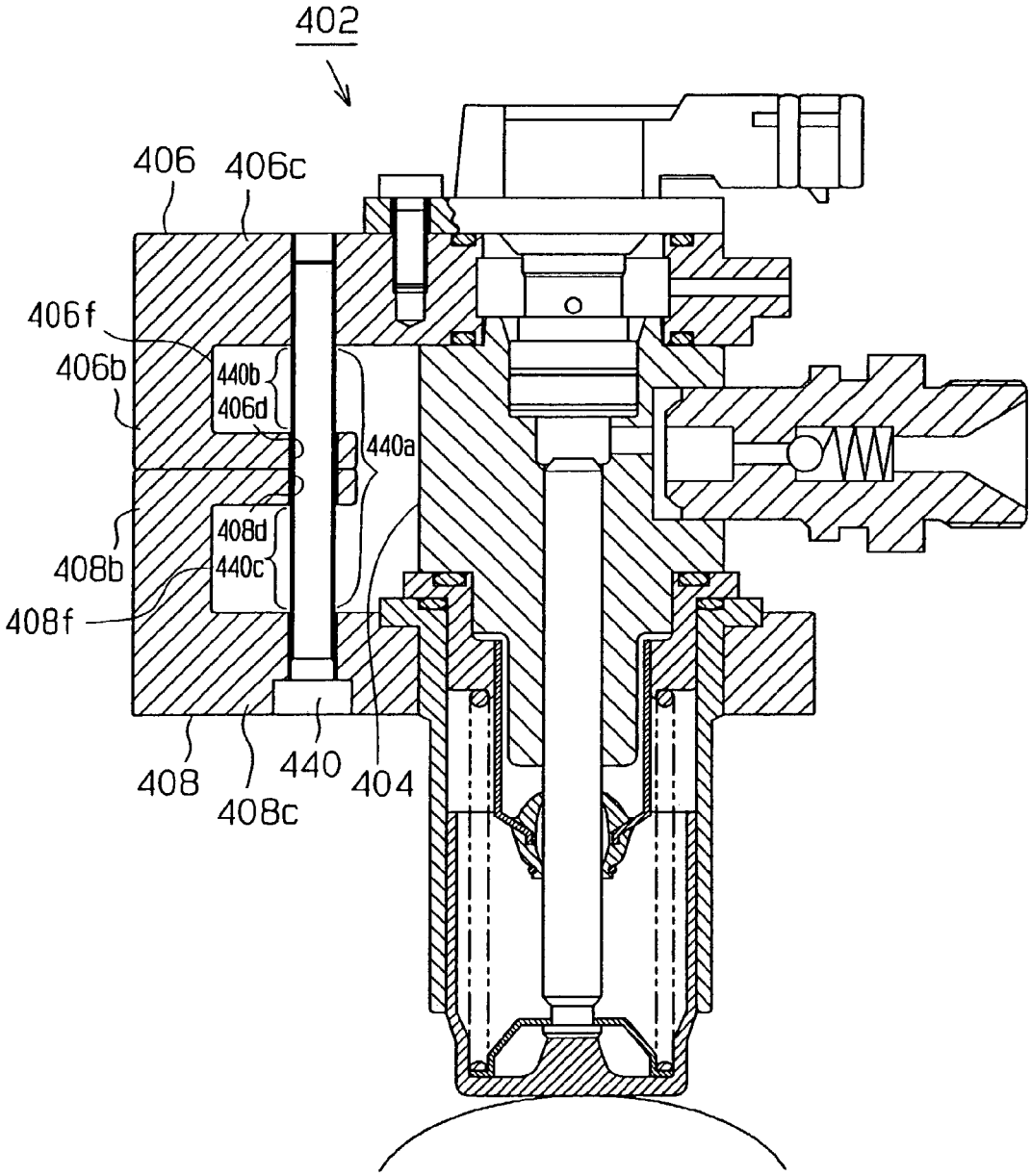
FIG. 13 is a cross sectional view of a high pressure fuel pump according to a further embodiment of the present invention.

As shown in FIG. 13, the distal ends of a contact portion 406*b* of a cover 406 and a contact portion 408*b* of a flange 408 are bent toward a clamping bolt 440. A central area 440*a* of the clamping bolt 440 may extend through holes 406*d*, 408*d* that are formed at distal ends of the contact portions 406*b*, 408*b*. The contact portion 406*b* has a separated portion 406*f* separated from the clamping bolt 440 by a predetermined distance and the contact portion 408*b* also has a separated portion 408*f*.

In this case also, the entire periphery at areas 440*b*, 440*c* of the central area 440*a* of the clamping bolt 440 are exposed. Therefore, in one of or both of the cover 406 and the flange 408 (in FIG. 13, both), flexing elastic deformation occurs at portions 406*c*, 408*c*, which are orthogonal to the axis of the clamping bolt 440. This clamps the cylinder body 404 (an intermediate member) with elastic force that has a low elastic coefficient.

The cover 406 and the flange 408 are engaged with each other at the contact portions 406*b*, 408*b*, which extend to the clamping bolt 440. Therefore, in the same manner as in FIG. 12, the transmission path of force from the contact portion 306*b*, 408*b* is separated from the clamping position of the cylinder body 404. The cylinder body 404 is clamped by the flexing deformation of the cover 406 and the flange 408. Even if the axial dimension of each component of the high pressure fuel pump 402 is not highly accurate and has tolerance, the tolerance does not cause a large change in the axial force of the clamping bolt 440, and the tolerance is absorbed.

The present examples and embodiments are to be considered as illustrative and not restrictive and the invention is not to be limited to the details given herein, but may be modified within the scope and equivalence of the appended claims.

The invention claimed is:

1. A high pressure pump comprising:

a plunger;

an intermediate member including a cylinder body for pressurizing fluid in a pressurizing chamber by reciprocating the plunger, wherein the cylinder body has a cylinder accommodating the plunger and the pressurizing chamber communicated with the cylinder;

a first clamping member and a second clamping member arranged on two ends of the intermediate member, both the first clamping member and the second clamping member receiving a bending force;

a valve mounted on the first clamping member, the valve selectively opening and closing the pressurizing chamber;

a clamping bolt extending between the two clamping members to clamp the intermediate member with the two clamping members, a portion of the first clamping member clamped by the clamping bolt protruding laterally from a solid body of the first clamping member and having a lower rigidity than that of the solid body of the first clamping member, and a portion of the second clamping member clamped by the clamping bolt being a flange-shaped peripheral portion; and a coupling structure for coupling the high pressure pump to a supporting member with the second clamping member and a fastening bolt, wherein the supporting member is a cover accommodating a cam therein, wherein the cam drives the plunger;

the second clamping member having a contact surface that contacts the cover;

the fastening bolt applying a force in a direction so that the second clamping member moves closer to the cover from a side opposite to the contact surface of the second clamping member; and the fastening bolt being screwed in a screwing hole formed in the cover, wherein the screwing hole penetrates only partially, and not all the way through the cover.

2. The high pressure pump according to claim 1, wherein the two clamping members clamp the intermediate member at a central position of the two clamping members and the two clamping members are clamped by the clamping bolt at peripheral portions of the clamping members.

3. The high pressure pump according to claim 2, wherein the intermediate member includes a cylinder body, a spring seat, and a lifter guide, wherein the cylinder body pressurizes fluid in the pressurizing chamber by reciprocating the plunger, wherein the lifter guide guides a lifter that moves with the plunger, and wherein the spring seat holds a spring in cooperation with the lifter, the spring urging the plunger in a direction where the plunger moves to draw fuel into the pressurizing chamber.

* * * * *

UNITED STATES PATENT AND TRADEMARK OFFICE

CERTIFICATE OF CORRECTION

PATENT NO. : 7,114,928 B2
APPLICATION NO. : 10/257715
DATED : October 3, 2006
INVENTOR(S) : Kazuhiro Asayama et al.

It is certified that error appears in the above-identified patent and that said Letters Patent is hereby corrected as shown below:

In the Title Page: After the listing of the inventors and before "(*) Notice:" change the assignee information to read as follows:

Item --(73) Assignee: Toyota Jidosha Kabushiki, Toyota (JP), Denso Corporation Kariya (JP)-- .

Signed and Sealed this

Thirtieth Day of January, 2007

JON W. DUDAS
*Director of the United States Patent and Trademark Office*